US006371478B1

(12) United States Patent
Jewell

(10) Patent No.: US 6,371,478 B1
(45) Date of Patent: Apr. 16, 2002

(54) ADAPTIVE APPARATUS FOR IMPROVING MEDIA SEPARATION

(75) Inventor: Robert W. Jewell, Boise, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/551,488

(22) Filed: Apr. 18, 2000

(51) Int. Cl.[7] ..... B65H 3/52
(52) U.S. Cl. ..... 271/124
(58) Field of Search ..... 271/110, 117, 271/124, 121

(56) References Cited

U.S. PATENT DOCUMENTS

| | | | | |
|---|---|---|---|---|
| 5,255,904 A | | 10/1993 | Tsguchi et al. | 271/18.1 |
| 5,377,969 A | | 1/1995 | Steinhilber | 271/21 |
| 5,383,654 A | | 1/1995 | Iseda | 271/9 |
| 5,385,342 A | | 1/1995 | Leib | 271/274 |
| 5,449,162 A | | 9/1995 | Saito et al. | 271/122 |
| 5,462,373 A | | 10/1995 | Chia | 400/62.4 |
| 5,537,227 A | | 7/1996 | Samii et al. | 358/498 |
| 5,678,817 A | | 10/1997 | Saito et al. | 271/122 |
| 5,915,862 A | | 6/1999 | Shimono et al. | 400/634 |
| 5,997,198 A | | 12/1999 | Murayama et al. | 400/624 |
| 6,273,416 B1 | * | 8/2001 | Watanabe et al. | 271/121 |
| 6,276,679 B1 | * | 8/2001 | Joyce et al. | 271/124 X |

* cited by examiner

*Primary Examiner*—David H. Bollinger

(74) *Attorney, Agent, or Firm*—Gregg W. Wisdom

(57) ABSTRACT

A media separator reduces the likelihood that multiple units of print media moved from an media tray will move through an imaging device. The media separator includes a separation member that is positioned by a position adjustment mechanism using output from a piezo electric sensor. A leading edge of the unit of print media moved from the media tray contacts the separation member. The angle between a plane of the unit of print media and a perpendicular to a tangent at a location the unit of print media contacts the surface of the separation member forms a contact angle. When multiple units of the print media are moved into the media path, a frictional force is exerted by the top unit of the print media upon the unit of print media below the top unit of print media. When the leading edge of the unit of print media below the top unit of print media contacts the separating member, a frictional force is exerted upon this unit of the print media by the separating member. If the contact angle of the unit of print media below the top unit of print media is less than a lock angle, the frictional exerted by the separating member upon this unit of the print media will overcome the frictional force exerted by the top unit of print media thereby stopping movement this unit of print media. The media separation member is positioned by the position adjustment mechanism and shaped so that in a multiple feed situation, the top unit of the print media moved from the media tray contacts the separating member at a contact angle greater than the lock angle while any units of the print media below the top unit of print media contact the separating member at a contact angle less than the lock angle, thereby prevent multiple units of the print media from moving over the separating member.

18 Claims, 4 Drawing Sheets

ADAPTIVE APPARATUS FOR IMPROVING MEDIA SEPARATION

FIELD OF THE INVENTION

This invention relates to the movement of media into a media path. More particularly, this invention relates to improving separation of media moved into the media path from a media input device.

BACKGROUND OF THE INVENTION

In moving media in a device, such as an imaging device, from a media input device it is desired that a single unit of the media is moved from the media input device each time an operation to move a unit of media from the media input device is initiated. However, in this moving operation, difficulty can be experienced in separating units of the media, so that some operations to move media from the media input device may cause multiple units of the media to be moved through the imaging device. A need exists for an improved apparatus and method for reducing the likelihood that more than one unit of the media is moved into the media path from the media input device from a moving operation.

SUMMARY OF THE INVENTION

Accordingly, a media separation apparatus has been developed. The media separation apparatus includes a separating member and a sensor positioned with respect to the separating member to generate an output related to a location where media contacts the separating member. The media separation apparatus further includes a position adjustment apparatus coupled to the separating member and configured to move the separating member in at least one dimension. In addition, the media separation apparatus includes a position controller coupled to the position adjustment apparatus and arranged to receive the output from the sensor, with the position controller configured to actuate the position adjustment apparatus to move the separating member so that the media contacts the separating member substantially at a predetermined location.

A method for separating a unit of media from a plurality of units of the media includes moving the plurality of units of the media from a media input device and moving the plurality of units of the media into contact with a separating member, with the unit of the media contacting the separating member substantially at a predetermined location and with remaining ones of the plurality of units of the media contacting the separating member away from the predetermined location. The method further includes moving the one of the plurality units of the media on the separating member and inhibiting movement of the remaining ones of the plurality of units of the media.

An imaging device for forming an image on media using toner includes an imaging mechanism. The imaging device further includes a media separator to deliver the media to the imaging mechanism including a separating member and a sensor positioned with respect to the separating member to generate an output related to a location at which the media contacts the separating member. The media separator also includes a position adjustment apparatus coupled to the separating member and configured to move the separating member in at least one dimension and a position controller coupled to the position adjustment apparatus and arranged to receive the output from the sensor. The position controller includes a configuration to actuate the position adjustment apparatus to move the separating member so that the media contacts the separating member substantially at a predetermined location.

DESCRIPTION OF THE DRAWINGS

A more thorough understanding of embodiments of the media separation apparatus may be had from the consideration of the following detailed description taken in conjunction with the accompanying drawings in which:

Shown in FIG. 1 is a simplified cross sectional drawing of an embodiment of an imaging device including an embodiment of the media separation apparatus.

Figure 2:
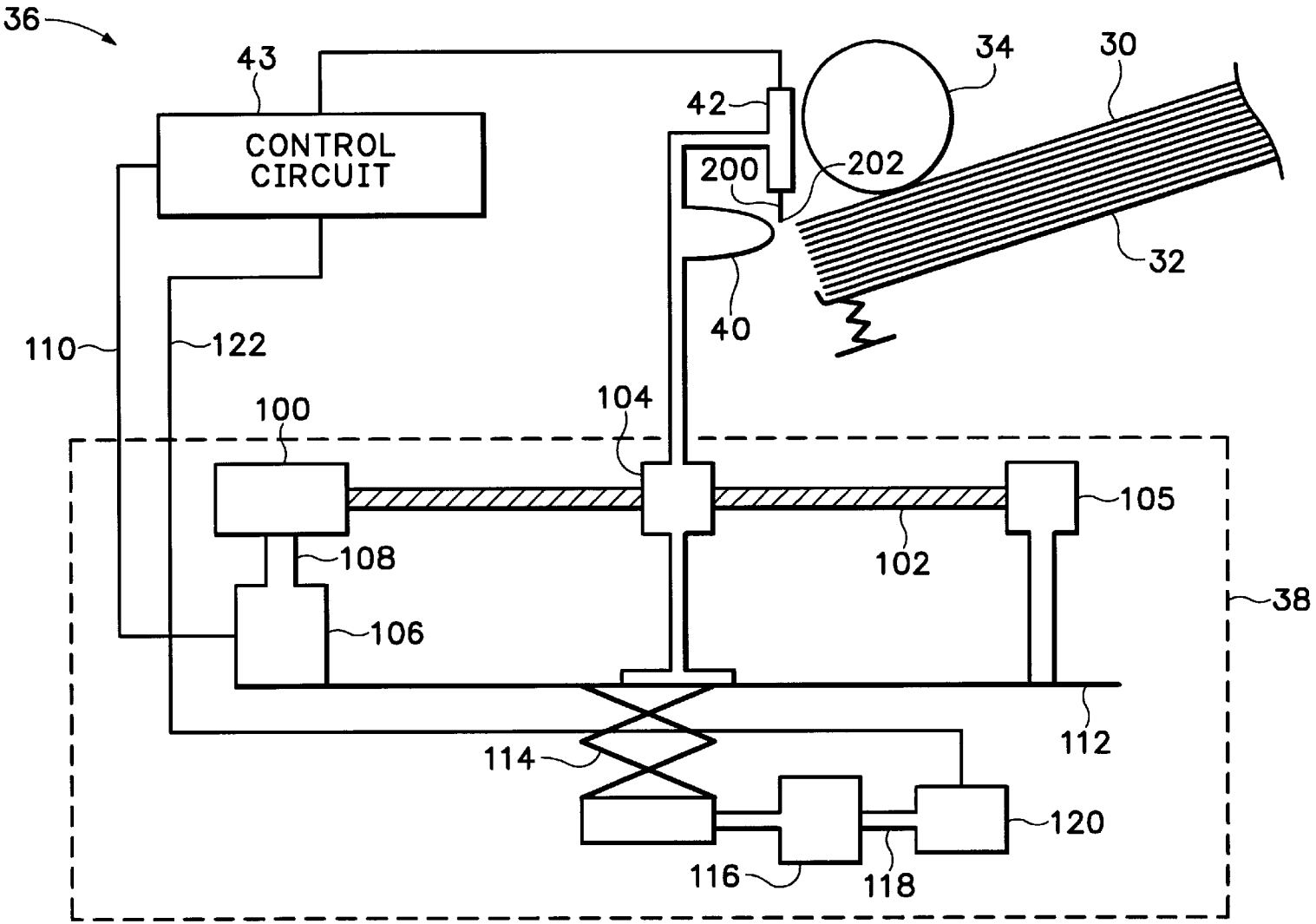

Shown in FIG. 2 is a simplified drawing of an embodiment of the media separation apparatus.

Figure 3:
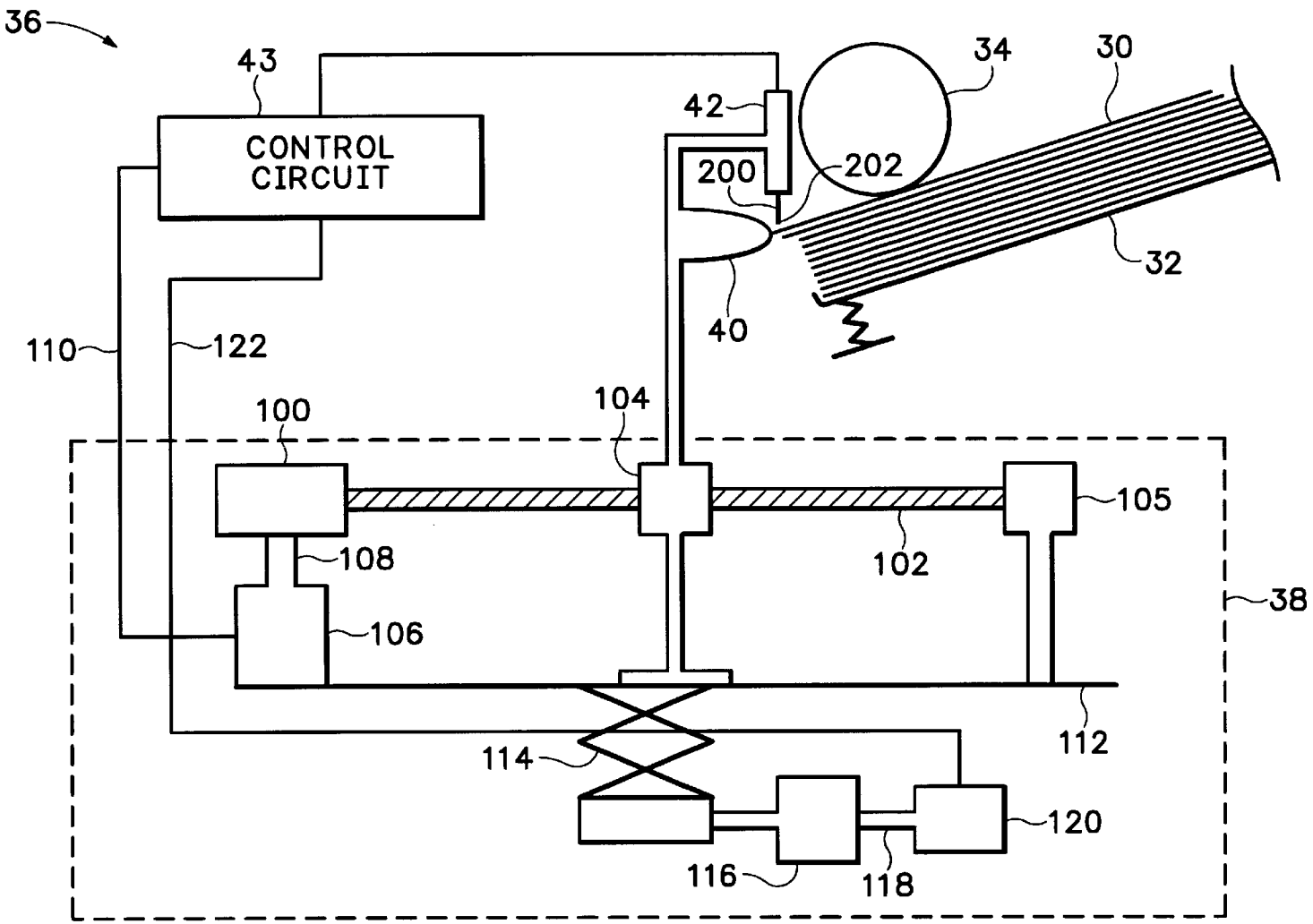

Shown in FIG. 3 is a drawing showing multiple units of print media moved into the media path from a media tray.

Figure 4:
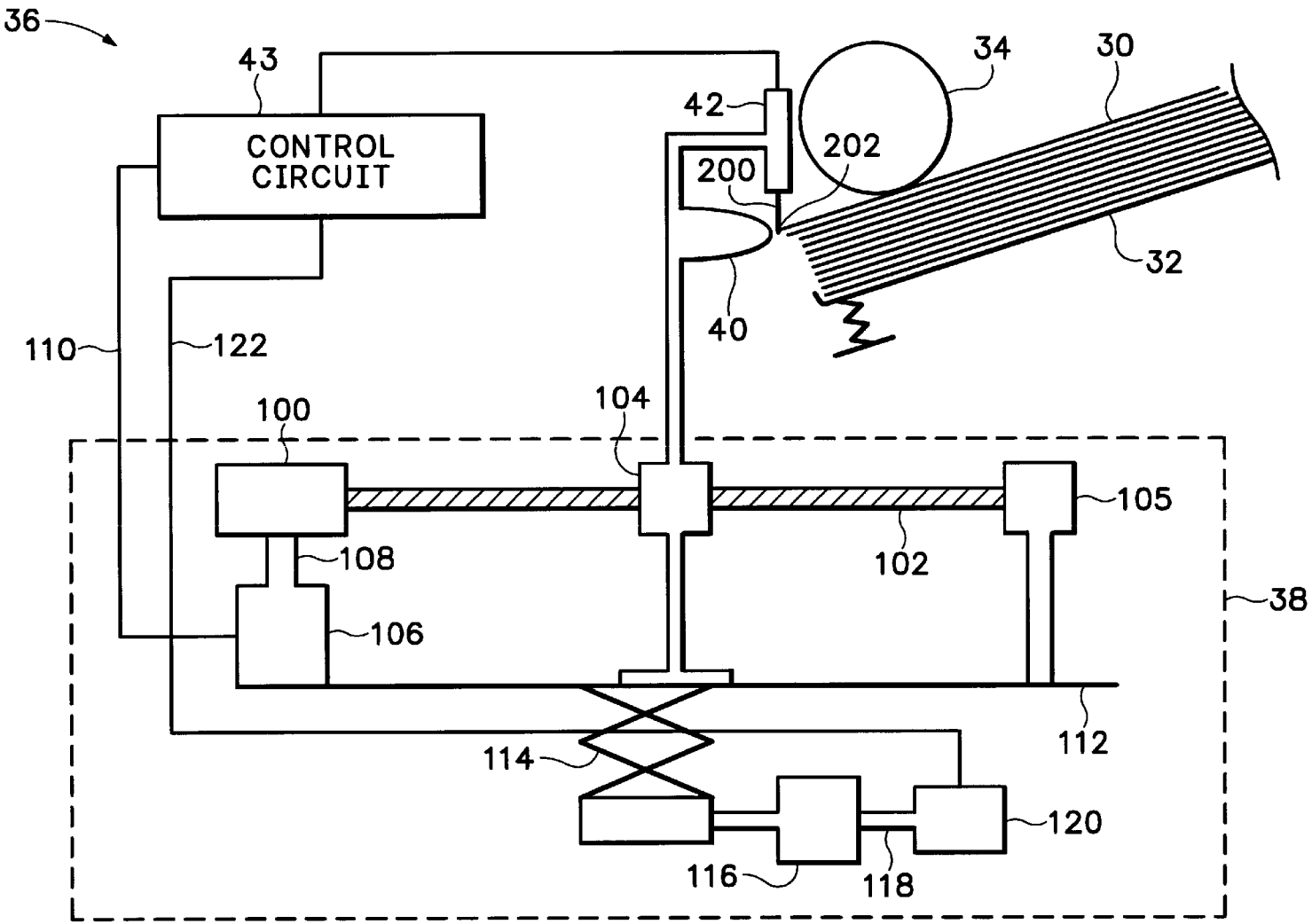

Shown in FIG. 4 is a drawing showing multiple units of print media moved into the media path with the top unit of print media contacting a sensor.

DETAILED DESCRIPTION OF THE DRAWINGS

Although embodiments of a media separation apparatus will be discussed in the context of an imaging device, such as an electrophotographic printer, it should be recognized that embodiments of the media separation apparatus may be beneficially used in other devices that move media from a media input device into a media path. For example, embodiments of the media separation apparatus may be used in an inkjet imaging device, an electrophotographic copier, a facsimile machine, or the like.

Figure 1:
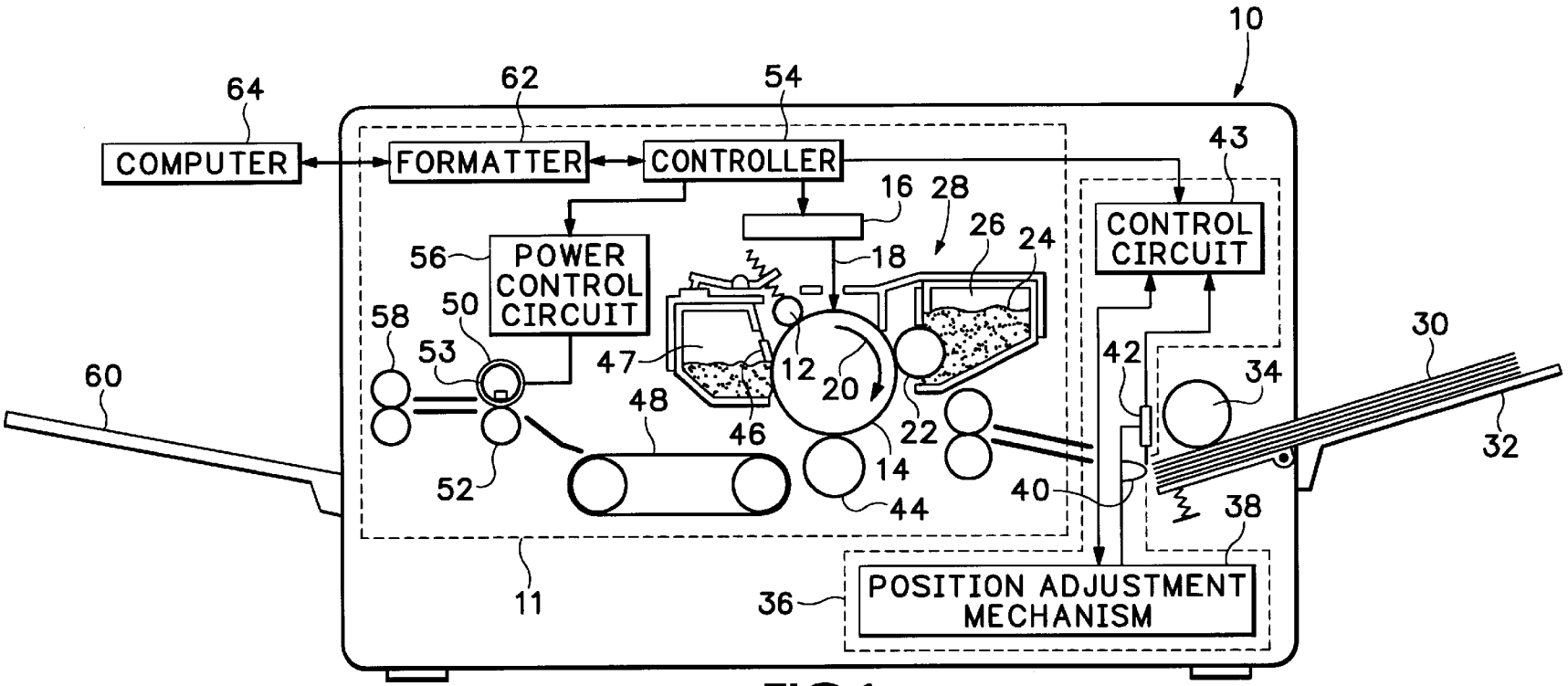

Shown in FIG. 1 is a simplified cross sectional view of an embodiment of an imaging device, such as imaging device 10, including an embodiment of the media separation apparatus and an embodiment of an imaging mechanism, imaging mechanism 11. Imaging mechanism 11 includes the hardware and firmware needed to form an image on media. For the case in which the imaging device includes an inkjet imaging device, the imaging device includes the hardware and firmware to control the positioning and operation of the inkjet print head. For the case in which the imaging device includes an electrophotographic copier, the imaging device includes the hardware and firmware for capturing the image to be copied and exposing the photoconductor.

In imaging device 10, charge roller 12 is used to charge the surface of a photoconductor, such as photoconductor drum 14, to a predetermined voltage. A laser diode (not shown) inside laser scanner 16 emits a laser beam 18 which is pulsed on and off as it is swept across the surface of photoconductor drum 14 to selectively discharge the surface of the photoconductor drum 14. Photoconductor drum 14 rotates in the clockwise direction as shown by the arrow 20. A developing device, such as developing roller 22, is used to develop the latent electrostatic image residing on the surface of photoconductor drum 14 after the surface voltage of the photoconductor drum 14 has been selectively discharged. Toner 24, which is stored in the toner reservoir 26 of electrophotographic print cartridge 28, moves from locationswithin the toner reservoir 26 to the developing roller 22. A magnet located within the developing roller 22 magnetically attracts toner 24 to the surface of the developing roller 22. As the developing roller 22 rotates in the counterclockwise direction, the toner 26, located on the surface of the developing roller 22 opposite the areas on the surface of photoconductor drum 14 which are discharged, can be moved across the gap between the surface of the photoconductor drum 14 and the surface of the developing roller 22 to develop the latent electrostatic image.

Media, such as print media 30 is loaded from a media input device, such as media tray 32, by pickup roller 34 into the media path of the imaging device 10. An embodiment of the media separation apparatus, media separator 36 is positioned in the media path. Media separator 36 reduces the likelihood that multiple units of print media 30 will be loaded from media tray 32 into the media path of imaging device 10.

Included in media separator 36 is an embodiment of a position adjustment apparatus, position adjustment mechanism 38. Position adjustment mechanism 38 is configured to adjust the position of an embodiment of a separating member, separating member 40. Also included in position adjustment mechanism 38 is an embodiment of a sensor, sensor 42 coupled to separating member 40, and an embodiment of a position controller, such as control circuit 43.

After passing media separator 36, a single unit of print media 30 moves through the media path so that the arrival of the leading edge of print media 30 below photoconductor drum 14 is synchronized with the rotation of the region on the surface of photoconductor drum 14 having a latent electrostatic image corresponding to the leading edge of print media 30.

As the photoconductor drum 14 continues to rotate in the clockwise direction, the surface of the photoconductor drum 14, having toner adhered to it in the discharged areas, contacts the print media 30 which has been charged by a transfer device, such as transfer roller 44,so that it attracts particles of toner 24 away from the surface of the photoconductor drum 14 and onto the surface of the print media 30. The transfer of particles of toner 24 from the surface of photoconductor drum 14 to the surface of the print media 30 is not fully efficient and therefore some toner particles remain on the surface of photoconductor drum 14. As photoconductor drum 14 continues to rotate, toner particles, which remain adhered to its surface, are removed by cleaning blade 46 and deposited in toner waste hopper 47.

As the print media 30 moves in the media path past photoconductor drum 14, conveyer 48 delivers the print media 30 to an embodiment of a fixing device, such as fuser 50. Fuser 50 is an instant on type fuser that includes a resistive heating element located on a substrate. Print media 30 passes between pressure roller 52 and fuser 50. Pressure roller 52 is coupled to a gear train (not shown in FIG. 1) in imaging device 10. Print media 30 passing between pressure roller 52 and print media 30 is forced against a sleeve 53 on the outside of fuser 50 by pressure roller 52. As pressure roller 52 and fuser 50 rotate, print media 30 is pulled between sleeve 53 and pressure roller 52. Heat applied to print media 30 by fuser 50 fixes toner 24 to the surface of print media 30.

Controller 54 is coupled to a power control circuit 56. Power control circuit 56 controls the electrical power supplied to fuser 50. Power control circuit 56 adjusts the duty cycle of the line voltage applied to fuser 50 to control the power supplied to fuser 50. After exiting fuser 50, output rollers 58 push the print media 30 into the output tray 60.

The embodiment of the imaging device shown in FIG. 1, imaging device 10, includes formatter 62. Formatter 62 receives print data, such as a display list, vector graphics, or raster print data, from the print driver operating in conjunction with an application program in computer 64. Formatter 62 converts this relatively high level print data into a stream of binary print data. Formatter 62 sends the stream of binary print data to controller 54. In addition, formatter 62 and controller 54 exchange data necessary for controlling the electrophotographic printing process. Controller 54 supplies the stream of binary print data to laser scanner 16. The binary print data stream sent to the laser diode in laser scanner 16 pulses the laser diode to create the latent electrostatic image on photoconductor drum 14.

In addition to providing the binary print data stream to laser scanner 16, controller 54 controls a high voltage power supply (not shown in FIG. 1) to supply voltages and currents to components used in the electrophotographic processes such as charge roller 12, developing roller 22, and transfer roller 44. Furthermore, controller 54 controls the drive motor (not shown in FIG. 1) that provides power to the printer gear train and controller 54 controls the various clutches and paper feed rollers necessary to move print media 30 through the media path of imaging device 10.

Shown in FIG. 2 is a simplified drawing of media separator 36. The position of separating member 40 is controlled through the action of an embodiment of a position adjustment apparatus, position adjustment mechanism 38, sensor 42, and control circuit 43. Position adjustment mechanism 38 includes a first gear reduction unit 100 that is used to drive a lead screw 102. Separating member 40 is coupled to lead screw 102 through threaded bushing 104. The end of lead screw 102 opposite that coupled to first gear reduction unit 100 rotates in bushing 105. First stepper motor 106 is coupled through first shaft 108 to first gear reduction unit 100. Control circuit 43 supplies a first control signal 110 to control the position of first shaft 108 on first stepper motor 106. As shaft first 108 rotates in response to first control signal 110 separating member 40 moves either to the right or the left (as depicted in FIG. 2), depending upon the direction of rotation of first shaft 108, to control the horizontal position of separating member 40.

Position adjustment mechanism 38 also includes the capability to control the vertical position of separating member 40. First stepper motor 106 is mounted upon plate 112. A scissor lifting device 114 is used to control the vertical position of separating member 40. A shaft from second gear reduction unit 116 is coupled to scissor lifting device 114. A second shaft 118 from second stepper motor 120 is coupled to second gear reduction unit 116. Rotation of second shaft 118 causes scissor lifting device 114 to move either up or down, depending upon the direction of rotation of second shaft 118, to control the vertical position of separating member 40. Control circuit 43 supplies a second control signal 122 to control the position of second shaft 118 on second stepper motor 120.

It should be recognized position adjustment mechanism 38 may be implemented in many different ways instead of using scissor lifting device 114 and lead screw 102 to control, respectively, the vertical and the horizontal position of separating member 40. A performance characteristic of particular importance for embodiments of the position adjustment apparatus is the capability to cause incremental movements of separating member 40 in either or both of the horizontal direction or the vertical direction.

An example of an alternative embodiment of a position adjustment apparatus includes a toothed belt and gear arrangement that could be used to control the horizontal position of separating member 40. For this implementation, a stepper motor could be used to rotate a gear meshing with the toothed belt. Separating member 40 would be coupled to the belt so that rotation of a shaft on the stepper motor would rotate the gear and cause movement of separating member 40. Decreasing the increment of horizontal movement associated with each rotational step of the shaft on the stepper motor could be achieved by using gear reduction. The vertical position of separating member 40 could be adjusted using a rack and pinion arrangement. The rack would be positioned in a vertical orientation. The pinion gear would be coupled to the shaft of a stepper motor mounted on a platform containing the hardware for the horizontal position adjustment. Adjustment of the vertical position of separating member 40 would be accomplished by rotation of the pinion gear by the stepper motor so that the platform would be displaced in the vertical direction. Decreasing the increment of vertical movement associated with each rotational step of the shaft on the stepper motor could be achieved by using gear reduction.

It should also be recognized that, depending upon the space available inside of the imaging device, embodiments of a position adjustment apparatus allowing movement in only one dimension may be used. For example, if the space available inside of the imaging device in the vertical direction was limited, an embodiment of the position adjustment apparatus that moved separating member 40 in the horizontal direction only could be used. Or, if the space available inside of the imaging device in the horizontal direction was limited, an embodiment of the position adjustment apparatus that moved separating member 40 in the vertical position only could be used. For either of these embodiments of the position adjustment apparatus, the design of separating member 40 would adapted to accomplish separation of units of print media 30 with position adjustments allowed in only one dimension.

Sensor 42 is coupled to control circuit 43. Control circuit 43 uses the output received from sensor 42 to control the position of separating member 40. Sensor 42 is positioned to detect the location at which the leading edge of print media 30 contacts separating member 40. In the embodiment of media separator 36 shown in FIG. 2, sensor 42 is rigidly coupled to separating member 40 to fix its position with respect to separating member 40. The member coupling sensor 42 to separating member 40 is attached at the sides of separating member 40 so that units of print media 30 move over separating member 40 unobstructed. If print media 30 loaded by pickup roller 34 into the media path does not contact separating member 40 at substantially the predetermined location, then control circuit 43 actuates position adjustment mechanism 38 so that units of print media 30 loaded into the media path at a later time contact separating member 40 substantially at the predetermined location.

Shown in FIG. 3 is an illustration of a condition in which two units of print media 30 have been moved out of media tray 32 by the rotation of pickup roller 34. Ideally, rotation of pickup roller 34 would cause the movement of a single unit of print media 30 into the media path. However, it is possible in some circumstances that two or more units of print media 30 may be pushed into the media path by the rotation of pickup roller 34. If the frictional force between the topmost unit of print media 30 in media tray 32 and the next lowest unit of print media 30 is sufficiently greater than the frictional force between the next lowest unit of print media 30 and the unit of print media 30 below this, then the next lowest unit of print media 30 will be loaded into the media path along with the topmost unit of print media 30. The frictional force between units of print media 30 is determined, in large part by the coefficient of friction between the units of print media 30. In turn, factors influencing the coefficient of friction include the surface texture of print media 30 and humidity.

Consider the case in which multiple units of print media 30 are pulled into the media path and in which separating member 40 is located in a predetermined position corresponding to the type of media contained in media tray 32. As the multiple units of print media 30 are moved by pickup roller 34 toward separating member 40 they begin to bend. Separating member 40 has been positioned so that when the leading edge of the multiple units of print media 30 contacts the surface of separating member 40, the top unit of print media 30 slides over separating member 40 while the units of print media 30 below the top unit are stopped from moving forward in the media path by separating member 40.

When the units of print media 30 below the top unit contact separating member 40, the coefficient of friction between these units of print media 30 and separating member 40 is sufficiently large so that the resulting frictional force overcomes the frictional force between the top unit of print media 30 and the unit of print media 30 below it. As a result, the top unit of print media 30 is pushed over the surface of the unit of print media 30 below it by pickup roller 34. After the top unit of print media 30 is moved out from under pickup roller 34 by its rotation, media tray 32 is moved upward by springs so the next unit of print media 30 is loaded against pickup roller 34. Then, when pickup roller 34 is rotated to load the next unit of print media 30 into the media path, this next unit is positioned so that it can be pushed over separating member 40, while those below it will be stopped.

The coefficient of friction that results from contact between the leading edge of units of print media 30 and the surface of separating member 40 is dependent upon the position at which units of print media 30 contact separating member 40. Consider a single unit of print media 30 contacting separating member 40. If a unit of print media 30 contacts separating member 40 at its apex, then it is very likely that this unit of print media 30 will not slide over separating member 40. For this situation, the unit of print media 30 will contact separating member 40 nearly perpendicular to a tangent to the surface of separating member 40 at the contact point. As the contact point of the unit of print media 30 is moved above the apex, the contact angle (defined by the angle between a plane of the unit of the print media 30 and a perpendicular to a tangent at the contact point with the surface of separating member 40) will increase. As the contact angle increases, the coefficient of friction between the leading edge of the unit of print media 30 and the surface of separating member 40 will decrease. Correspondingly, the frictional force exerted by the surface of separating member 40 upon the unit of print media 30 will also decrease.

Consider the case in which two units of print media 30 are pulled form media tray 32 into the media path by the rotation of pickup roller 34. The contact angle at which the frictional force exerted by the surface of separating member 40 upon the bottom one of the two units of print media 30 equals the frictional force exerted upon the bottom one of the two units of print media 30 by the top unit of print media 30, is the lock angle. At contact angles less than the lock angle, the motion of the bottom of the two units of print media 30 will be stopped while pickup roller 34 will push the top unit of print media 30 over separating member 40. For contact angles greater than the lock angle, the unit of print media 30 below the top unit will be in sliding contact with the top unit while the top unit is moving over separating member 40 and therefore a multiple feed error will result. For situations in which more than two units of print media 30 are pulled into the media path by the rotation of pickup roller 34, movement of the additional units of print media 30 will also be stopped when movement of the unit of print media 30 below the top unit is stopped.

The lock angle is dependent upon a variety of factors. Factors which effect the lock angle include the coefficient of friction of between units of print media 30, the coefficient of friction between a unit of print media 30 and the surface of separating member 40, and the normal force exerted by pickup roller 34 on print media 30 stored in media tray 32. Because these factors may be difficult to quantify over the entire range of variability, it may be preferable to determine the lock angle for a specific implementation empirically instead of analytically.

The coefficient of friction between a unit of print media 30 and the surface of separating member 40 can be controlled over a range by design. The material from which separating member 40 is constructed may be selected to achieve this desired range coefficient of friction between the leading edge of print media 30 and the surface of separating member 40. For example, a plastic material having a texture molded into its surface may be used for separating member 40 to achieve the desired coefficient of friction. Alternatively, a surface coating may be placed onto separating member 40 to achieve the desired coefficient of friction or a membrane may be bonded to a substrate to achieve the desired coefficient of friction. The material or surface texture necessary to achieve the desired coefficient of friction could be empirically determined by measuring the force required to move different types of print media 30 (contacting separating member 40 at a contact angle just larger than the lock angle) over separating member 40.

It should be recognized that separating member 40 can have a variety of shapes. For example, a separating member could be formed from a cylindrically shaped member having an appropriate radius of curvature. Furthermore, it should be recognized that separating member 40 could have a variety of widths. Separating member 40 could be at least as wide as the media path or it could be less than width of media path as long as it is of sufficiently wide to accomplish separation of print media 30. Separating member 40 works particularly well when its surface has a sufficiently small radius of curvature so that there are locations on the surface where, over the thickness of a single unit of print media 30, the contact angle can change from less than the lock angle to greater than the lock angle. Separating member 40 also works particularly well when it has a shape and is positioned so that the top most unit of print media 30 contacts the surface of separating member 40 at greater than the lock angle while the unit of print media 30 below the top most unit contacts the surface of separating member 40 substantially perpendicular to a tangent to the contact point. By using embodiments of separating member 40 having these characteristics, the position of separating member 40 can be adjusted so that it is very likely that units of print media 30 below the top unit pulled into the media path are stopped from moving over separating member 40 while permitting the top unit of print media 30 to slide over separating member 40 relatively easily. Generally, embodiments of separating member 40 having a minimum radius of curvature less than 10 times the thickness of a unit of print media 30 will perform acceptably. However, if the minimum radius of curvature of the surface of separating member 40 is too small, then the size of the area on separating member 40 used for stopping movement of print media 30 will be correspondingly reduced, thereby making it more difficult to consistently separate units of print media 30.

When power is applied to imaging device 10, control circuit 43 actuates position adjustment mechanism 38 to move separating member 40 to a predetermined position. The predetermined position of separating member 40 is determined empirically. For example, measurements could be made to determine the position of separating member 40 so that for one of the most commonly used types of print media 30, such as 20 lb 8½" by 11½" paper, only the top unit of the multiple units of print media 30 pulled into the media path is able to pass over separating member 40. The predetermined position would be set so that, initially, the top unit of print media 30 moved from input tray 32 into the media path would contact the surface of separating member 40 at a location slightly below the ideal location (toward the apex) on separating member 40. The predetermined position may be affected by the stiffness of the most commonly used type of print media 30. Subsequent adjustment of the position of separating member 40 would be performed so that top units of print media 30 moved into the media path would contact separating member 40 substantially at the ideal location.

Sensor 42 is used in a feedback loop to adjust the position of separating member 40. Separating member 40 is moved from its initial position on power up to the position at which it will be effective for separating units of print media 30 through the operation of feedback. To accomplish this adjustment, sensor 42 is configured to detect whether the leading edge of the top unit of print media 30 contacts a predetermined location on the surface of separating member 40 at greater than the lock angle while a unit of print media 30 below it will contact separating member 40 at less than the lock angle. If the output from sensor 42 indicates that the leading edge of the top unit contacts the surface of separating member 40 below this predetermined location (toward the apex), then control circuit 43 will use position adjustment mechanism 38 to move separating member 40 so that when subsequent units of print media 30 are moved into the media path, the leading edges will contact separating member 40 at substantially the predetermined location.

Shown in FIG. 4 is a drawing illustrating how sensor 42 determines whether a unit of print media 30 will contact the predetermined location on the surface of separating member 40. The embodiment of sensor 42 shown in FIG. 4 includes a piezo electric proximity sensor. Sensing member 200 is positioned vertically with respect to the surface of separating member 40 so that units of print media 30 that contact end 202 will contact the surface of separating member 40 substantially at the predetermined location, while those units of print media 30 that will contact the surface of separating member 40 below the predetermined location (toward the apex) will not contact end 202. When sensing member 200 is contacted by a unit of print media 30, sensing member 200 will slightly deflect. The bending of sensing member 200 causes sensor 42 to generate an output signal indicating that contact has occurred.

As previously mentioned, separating member 40 is initially positioned so that the most commonly used type of print media 30 will contact separating member 40 slightly below the predetermined location. However, depending upon the type of print media 30 contained in media tray 32, a unit of print media 30 may contact the surface of separating member 40 above or below the predetermined location. When an imaging operation is initiated after power up of imaging device 10, controller 54 signals control circuit 43 that pickup roller 34 will rotate to move a unit of print media 30 into the media path. Control circuit 43 monitors the output of sensor 42 to determine if the unit of print media 30 contacts sensing member 200. If the unit of print media 30 contacts sensing member 200, this indicates that the unit of print media 30 will contact separating member 40 at or above the predetermined location. If the unit of print media 30 does not contact sensing member 200, this indicates that the unit of print media 30 will contact separating member 40 below the predetermined location.

If control circuit 43 detects contact of sensing member 200 with the unit of print media 30, control circuit 43 will signal position adjustment mechanism 38 to raise separating member 40 an incremental amount. If the next unit of print media 30 moved into the media path contacts sensing member 200, then control circuit 43 will signal position adjustment mechanism 38 to raise separating member 40 the incremental amount. This process will be continued until control circuit 43 detects that a unit of print media 30 moved into the media path does not contact sensing member 200. When this occurs, control circuit 43 will signal position adjustment mechanism 38 to lower separating member 40 by the incremental amount. The resulting position of separating member 40 will be assumed to be the position for which the top unit of print media 30 in a multiple feed condition contacts the predetermined location.

If control circuit 43 does not detect contact of sensing member 200 for the first unit of print media 30 moved into the media path after power up, then control circuit 43 will signal position adjustment mechanism 38 to lower separating member 40 the incremental amount. If the next unit of print media 30 moved into the media path does not contact sensing member 200, then control circuit 43 will signal position adjustment apparatus 38 to lower separating member 40 the incremental amount. This process will be continued until control circuit 43 detects that a unit of print media 30 moved into the media path contacts sensing member 200. When this occurs, the resulting position of separating member 40 will be assumed to be the position for which the top unit of print media 30 in a multiple feed situation contacts the predetermined location.

The resulting position of separating member 40 may be a position that causes the top unit of print media 30 in a multiple feed situation to contact the surface of separating member 40 substantially at, but not exactly at, the predetermined location. The size of the increment that control circuit 43 causes position adjustment mechanism 38 to move separating member 40 will affect the difference between the resulting position and the position at which the top unit of print media 30 in a multiple feed situation will contact the predetermined location. To reduce the magnitude of the difference, control circuit 43 could be configured to cause position adjustment mechanism 38 to move in smaller increments. In the embodiment of position adjustment apparatus shown in FIG. 2, the incremental movement (in either the horizontal or vertical direction) of separating member 40 that can be achieved with each step of either first stepper motor 106 or second stepper motor 120 is affected by the step size of the each of the stepper motors and the gear reduction that is achieved in first gear reduction unit 100 and second gear reduction unit 116. Although the adjustment of separating member 40 has been discussed in the context of vertical adjustments, it should be recognized that a similar process could be applied to horizontal adjustments or a combination of horizontal and vertical adjustments.

Although the disclosed embodiment of the media separator uses a piezo electric sensor for sensor 42, it should be recognized that other types of sensors may be used. For example, sensor 42 could include optical sensors that are positioned to determine the location at which units of print media 30 contact the surface of separating member 40. Other types of sensors may be used if they include the capability to determine (to some degree of accuracy) the location at which units of print media 30 contact the surface of separating member 40.

The previously described adjustment process for determining the position of separating member 40 is performed using the output of sensor 42 obtained from successive units of print media 30 moved into the media path during imaging operations. It should be recognized, that this adjustment process could also be performed after power up by moving multiple units of print media 30 through the media path without performing the imaging operation. Furthermore, the adjustment process may be repeated after power is applied to imaging device 10. For example, control circuit 43 could be configured to perform the adjustment process on a periodic basis to account for changes in environmental conditions or changes in type of print media 30 in media tray 32. Or alternatively, controller 54 or control circuit 43 could be configured to include the capability for detecting the loading of media tray 32. After the loading of media tray 32, the adjustment process would be performed. Where print media 30 in media tray 32 is infrequently replaced (such as might be the case for an imaging device having a large capacity media tray for relatively high volume imaging jobs), the adjustment process may be performed infrequently. Where it is more likely that the type of print media 30 in media tray 32 will change frequently, the adjustment process will be performed frequently.

Although several embodiments of the media separation apparatus have been discussed, it is readily apparent to those of ordinary skill in the art that various modifications may be made to these embodiments without departing from the spirit of the invention or from the scope of the appended claims.

What is claimed is:

1. A media separation apparatus, comprising:

a separating member;

a sensor positioned with respect to the separating member to generate an output related to a location where media contacts the separating member;

a position adjustment apparatus coupled to the separating member and configured to move the separating member in at least one dimension; and a position controller coupled to the position adjustment apparatus and arranged to receive the output from the sensor, with the position controller configured to actuate the position adjustment apparatus to move the separating member so that the media contacts the separating member substantially at a predetermined location.

2. The apparatus as recited in claim 1, wherein:

with the separating member located adjacent to a media input device, the separating member includes a shape so that with a plurality of units of the media moved from the media input device a one of the plurality of units of the media can move on the separating member while inhibiting movement of remaining ones of the plurality of units of the media after contact with the separating member.

3. The apparatus as recited in claim 2, wherein:

the shape includes curvature so that the one of the plurality of units of the media can contact the separating member substantially at the predetermined location while the remaining ones of the plurality of units of the media can contact the separating member away from the predetermined location toward an apex of the curvature.

4. The apparatus as recited in claim 3, wherein:

the one of the plurality of the units of the media corresponds to a unit of the media intended to be moved from the media input device.

5. The apparatus as recited in claim 4, wherein:

The sensor includes a piezo electric sensor having a sensing member, with the sensing member positioned adjacent to the surface so that the one of the plurality of the units of the media contacts the sensing member before contacting the separating member substantially at the predetermined location.

6. The apparatus as recited in claim 5, wherein:

the position adjustment apparatus includes a first stepper motor configured to rotate a first shaft responsive to a first signal to move the separating member a first amount in a horizontal direction.

7. The apparatus as recited in claim 6, wherein:

the position adjustment apparatus includes a second stepper motor configured to rotate a second shaft responsive to a second signal to move the separating member a second amount in a vertical direction.

8. A method for separating a unit of media from a plurality of units of the media, comprising:

adjusting a position of a separating member so that the unit of the media will contact the separating member substantially at a predetermined location;

moving the plurality of units of the media from a media input device;

moving the plurality of units of the media into contact with the separating member, with the unit of the media contacting the separating member substantially at the predetermined location and with remaining ones of the plurality of units of the media contacting the separating member away from the predetermined location;

moving the unit of the media on the separating member; and inhibiting movement of the remaining ones of the plurality of units of the media.

9. The method as recited in claim 8, wherein:

adjusting the position of the separating member includes moving a first unit of the media to contact the separating member at a location;

determining if the location corresponds substantially to the predetermined location; and moving the separating member if the first unit of the media contacts the separating member with the location other than substantially at the predetermined location.

10. The method as recited in claim 9, wherein:

determining the location at which the first unit of the media contacts the separating member includes using a sensor to determine the location.

11. An imaging device for forming an image on media using toner, comprising:

an imaging mechanism; and a media separator to deliver the media to the imaging mechanism including a separating member, a sensor positioned with respect to the separating member to generate an output related to a location at which the media contacts the separating member, a position adjustment apparatus coupled to the separating member and configured to move the separating member in at least one dimension, and a position controller coupled to the position adjustment apparatus and arranged to receive the output from the sensor, with the position controller configured to actuate the position adjustment apparatus to move the separating member so that the media contacts the separating member substantially at a predetermined location.

12. The imaging device as recited in claim 11, further comprising:

a media input device located adjacent to the separating member, where the separating member includes a shape so that with a plurality of units of the media moved from the media input device a one of the plurality of units of the media can move on the separating member while inhibiting movement of remaining ones of the plurality of units of the media after contact with the separating member.

13. The imaging device as recited in claim 12, wherein:

the shape includes curvature so that the one of the plurality of units of the media can contact the separating member substantially at the predetermined location while the remaining ones of the plurality of units of the media can contact the separating member away from the predetermined location toward an apex of the curvature.

14. The imaging device as recited in claim 13, wherein:

the one of the plurality of the units of the media corresponds to a unit of the media intended to be moved from the media input device.

15. The imaging device as recited in claim 14, wherein:

the sensor includes a piezo electric sensor having a sensing member, with the sensing member positioned adjacent to the surface so that the one of the plurality of the units of the media contacts the sensing member before contacting the separating member substantially at the predetermined location.

16. The imaging device as recited in claim 15, wherein:

the position adjustment apparatus includes a first stepper motor configured to incrementally rotate a first shaft responsive to a first signal to incrementally move the separating member a first amount in a horizontal direction.

17. The imaging device as recited in claim 16, wherein:

the position adjustment apparatus includes a second stepper motor configured to incrementally rotate a second shaft responsive to a second signal to incrementally move the separating member a second amount in a vertical direction.

18. The imaging device as recited in claim 17, where:

the imaging mechanism includes a photoconductor, a photoconductor exposure device to form a latent electrostatic image on the photoconductor, a developing device to develop the toner onto the media, a transfer device to transfer the toner from the photoconductor to the media, and a fixing device to fix toner to the media.

* * * * *